US011317706B2

(12) United States Patent
Berhault

(10) Patent No.: US 11,317,706 B2
(45) Date of Patent: May 3, 2022

(54) BRUSH FOR APPLYING A COSMETIC PRODUCT TO THE EYELASHES AND/OR EYEBROWS, COMPRISING CUTOUTS

(71) Applicant: L'OREAL, Paris (FR)

(72) Inventor: Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 354 days.

(21) Appl. No.: 15/567,866

(22) PCT Filed: Apr. 15, 2016

(86) PCT No.: PCT/EP2016/058446
§ 371 (c)(1),
(2) Date: Oct. 19, 2017

(87) PCT Pub. No.: WO2016/169864
PCT Pub. Date: Oct. 27, 2016

(65) Prior Publication Data

US 2018/0103749 A1 Apr. 19, 2018

(30) Foreign Application Priority Data

Apr. 21, 2015 (FR) ..... 1553557

(51) Int. Cl.
*A45D 40/26* (2006.01)
*A46B 9/02* (2006.01)
(Continued)

(52) U.S. Cl.
CPC ..... *A46B 9/028* (2013.01); *A45D 40/265* (2013.01); *A45D 40/267* (2013.01); *A46B 3/18* (2013.01);
(Continued)

(58) Field of Classification Search
CPC .... A45D 40/265; A45D 40/267; A46B 9/028; A46B 9/021; A46B 9/026; A46B 3/18; A46B 5/0079; A46B 2200/1053
(Continued)

(56) References Cited

U.S. PATENT DOCUMENTS 3,892,248 A † 7/1975 Kingsford
4,586,520 A † 5/1986 Brittain
(Continued)

FOREIGN PATENT DOCUMENTS

EP 0 792 603 A1 9/1997
EP 1 236 421 A1 9/2002
(Continued)

OTHER PUBLICATIONS

International Search Report for PCT/EP2016/058446 dated Jul. 25, 2016 (2 pages).

*Primary Examiner* — Rachel R Steitz
(74) *Attorney, Agent, or Firm* — Shumaker, Loop & Kendrick, LLP

(57) ABSTRACT

The present invention relates to a brush (10) for applying a product (P) to the eyelashes and/or eyebrows, comprising: a core (40) that extends along a longitudinal axis X, and bristles (41) that extend from the core (40) along a portion of length $L_2$, the ends of the bristles (41) defining an envelope surface, the envelope surface having at least one longitudinally extending cutout, the cutout having: a length $L_2$ where $L_2 \geq L_1/2$, a width w, measured at the bottom of the cutout, that is constant along at least a portion of its length $L_2$, and a distance d from the longitudinal axis X that varies along its length $L_2$.

14 Claims, 6 Drawing Sheets

Figure 1:
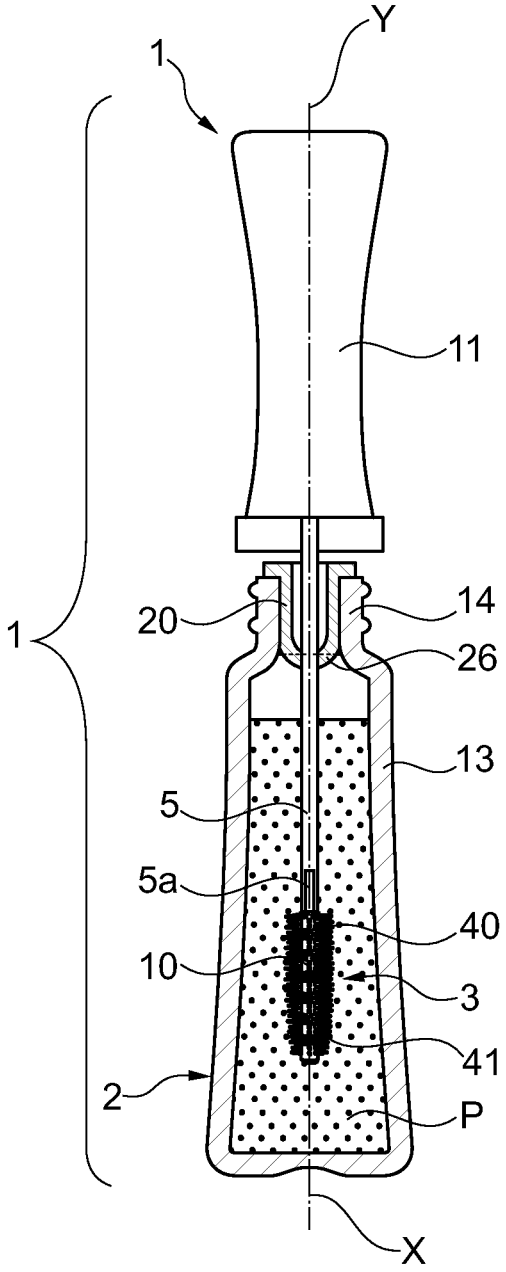

(51) Int. Cl.
*A46B 3/18* (2006.01)
*A46B 5/00* (2006.01)

(52) U.S. Cl.
CPC ..... *A46B 5/0079* (2013.01); *A46B 9/021* (2013.01); *A46B 9/026* (2013.01); *A46B 2200/1053* (2013.01)

(58) Field of Classification Search
USPC ..... 132/218; 300/17, 21
See application file for complete search history.

(56) References Cited

U.S. PATENT DOCUMENTS

| | | | | |
|---|---|---|---|---|
| 2005/0081874 | A1* | 4/2005 | Mathiez ..... | A46B 3/18<br>132/218 |
| 2007/0034223 | A1† | 2/2007 | Dumler | |

FOREIGN PATENT DOCUMENTS

| | | | |
|---|---|---|---|
| EP | 1 518 477 | A1 | 3/2005 |
| FR | 2 715 038 | A1 | 7/1995 |
| FR | 2 836 800 | A1 | 9/2003 |
| FR | 2 991 560 | A1 | 12/2013 |

* cited by examiner
† cited by third party

BRUSH FOR APPLYING A COSMETIC PRODUCT TO THE EYELASHES AND/OR EYEBROWS, COMPRISING CUTOUTS

The present invention relates to brushes for applying a cosmetic product to the eyelashes or eyebrows, notably a makeup or care product, for example mascara, and to corresponding packaging and application devices.

A large number of applicators, in which the brush comprises a core formed by two arms of a metal wire that are twisted together and grip bristles, are known.

Since the bristles used are generally the same length, once the arms are twisted, the brush has an envelope surface in the form of a cylinder of revolution. Such a cylinder of revolution form has limited effectiveness in terms of loading the eyelashes and separation.

Efforts have thus been made to give the envelope surface more complex shapes so as to form on the brush, after wiping, zones that are more heavily laden with product, making it possible to properly load the eyelashes, and zones that are less heavily laden or are laden little, these being usable to separate the eyelashes. Finding the form that results in the optimum makeup result requires numerous tests, since many factors come into play.

In addition, it is economically advantageous for the brush to be able to be manufactured quickly and easily.

Numerous brushes have been proposed, with cutouts machined in the longitudinal direction of the core.

Thus, the patent application FR 2 836 800 describes a brush comprising at least one cutout that extends along a part of the length of the brush.

The patent applications EP 0 792 603, EP 1 236 421, FR 2 991 560 and FR 2 715 038 relate to brushes comprising cutouts that each have a variable width.

The patent application EP 1 518 477 discloses a brush having cutouts that are at a constant distance from the longitudinal axis of the brush.

To date, there is still a need to improve brushes for applying a cosmetic product to the eyelashes and/or eyebrows, notably to benefit from brushes that are capable of satisfactorily making up the eyelashes and eyebrows, by providing a sufficient load of product.

The invention aims to meet this need and the subject thereof, according to one of its aspects, is a brush for applying a product to the eyelashes and/or eyebrows, comprising:

- a core that extends along a longitudinal axis X, and
- bristles that extend from the core along a portion of length $L_1$, the ends of the bristles defining an envelope surface S, the envelope surface having at least one longitudinally extending cutout, the cutout having:

- a length $L_2$ where $L_2 \geq L_1/2$,
- a width w, measured at the bottom of the cutout, that is constant along at least a portion of its length $L_2$, and
- a distance d from the longitudinal axis that varies along its length.

By virtue of the cutouts, the brush according to the invention is notably able to store product along the majority of its length so as to provide a sufficient load of product to the eyelashes and/or eyebrows.

The constant width of the bottom of the cutout along a portion of its length makes manufacturing easier, since the cutout can be hollowed out by a cutting tool moving along the longitudinal axis of the core, rotating on itself about a rotation axis perpendicular to the longitudinal axis of the core.

By virtue of the invention, it is possible to have a cutout that is bordered by relatively stiff flanks, if desired, thereby making crests for separating the eyelashes.

The variable depth of the cutout makes it possible to have more product in a predefined region of the brush, for example around half-way along, and less product elsewhere; it may be advantageous to have less product close to the distal end of the brush, so as to use this region of the brush to properly separate the eyelashes, in particular those at the corner of the eye.

The cutout may be produced by moving a tool for cutting the bristles both along an axis parallel to the longitudinal axis of the core and along an axis perpendicular to the longitudinal axis of the core, the longitudinal movement making it possible to define the length $L_2$ of the cutout and the perpendicular movement making it possible to define the distance d from the longitudinal axis. The cutting tool may have a longitudinal axis perpendicularly to the longitudinal axis of the core and parallel to the bottom of the cutout or, in a variant, perpendicular to the width of the bottom of the cutout. Preferably, this cutting tool is rotated about its longitudinal axis. The width of the cutting end of the cutting tool gives the width w of the cutout.

In a variant, such a cutout is produced by moving a cutting tool about a rotation axis perpendicular to the longitudinal axis of the core, notably an axis parallel to the bottom of the cutout. The cutting tool may have a longitudinal axis perpendicular to the bottom of the cutout. Preferably, this cutting tool is rotated about its longitudinal axis.

Preferably, the length $L_2$ of the cutout is such that $L_2 \geq 2/3L_1$. This makes it possible to have a cutout which extends along a great majority of the length of the core carrying the bristles, thereby making it possible notably to obtain the desired effect on most of the eyelashes with minimum hand movements.

The width w of the cutout may be constant along a portion of length $L_3$ of the cutout greater than or equal to 10% of the length $L_2$ of the cutout, better still greater than or equal to 50% of the length $L_2$ of the cutout, even better still greater than or equal to 75% of the length $L_2$ of the cutout, and even better still along the entire length $L_2$ of the cutout.

The distance d from the longitudinal axis, measured in a longitudinal mid-plane of the cutout, can vary continuously along the length of the cutout. The distance d from the longitudinal axis can change along a curve that does not have any angular points. This makes it possible to vary, notably continuously, the quantity of product stored in the brush depending on the position along the longitudinal axis X.

The bottom of the cutout may have, in longitudinal section, a profile that is concave towards the outside, notably having a radius of curvature r towards the outside of between 20 mm and 80 mm, better still between 40 mm and 65 mm.

The cutout may have, in cross section, a flat bottom or a bottom that is convex towards the outside. When the bottom is convex towards the outside, the bottom may form, in cross section, a circular arc having a radius substantially equal to the distance d from the longitudinal axis.

The shape of the bottom of the cutout is defined entirely by the cutting tool. When the bottom is flat in cross section, the longitudinal axis of the cutting tool is, preferably, perpendicular to the bottom of the cutout or to the width of the bottom of the cutout. When the bottom of the cutout is convex towards the outside in cross section, the longitudinal axis of the cutting tool is, preferably, parallel to the bottom of the cutout and the surface of the cutting tool forming the bottom of the cutout has a concave profile towards the outside in the widthwise direction of the bottom of the cutout.

The flanks of the cutout preferably diverge towards the outside. The flanks of the cutout may form an angle $\alpha$ of between 20° and 60°, better still between 30° and 50°, even better still between 35° and 45°, between one another. The shape of the flanks is notably due to the radial orientation of the bristles starting from the core. Specifically, the flanks are formed by the bristles next to the cutout which have not been severed by the cutting tool.

The width w of the cutout may be between 1 mm and 4 mm, better still between 1.5 mm and 3.5 mm.

The ratio w/W may be between 0.9 and 0.4, preferably between 0.8 and 0.7, W being the width of the cutout measured at the surface thereof.

The minimum distance $d_{min}$ from the longitudinal axis may be between 1 mm and 4 mm, better still between 2.5 mm and 3.5 mm.

The ratio $2d_{min}/D$ may be between 0.4 and 0.9, better still between 0.6 and 0.9.

The envelope surface preferably has a plurality of cutouts, notably between 3 and 6 cutouts, preferably 4 cutouts.

Preferably, the cutouts are distributed evenly around the core.

The envelope surface, apart from the cutouts, may be cylindrical. The envelope surface, apart from the cutouts, may have a section of revolution, notably a circular section, having a diameter D. The ratio w/D may be between 0.4 and 0.1, preferably between 0.3 and 0.2.

The envelope surface may be symmetric with respect to the longitudinal axis of the core.

In a variant, the envelope surface does not exhibit axial symmetry. This can make it possible to obtain a particular makeup effect.

Preferably, the core is a twisted core. The expression "twisted core" should be understood as meaning a core formed by twisting two arms of a metal wire together in a conventional manner.

The longitudinal axis X is preferably rectilinear.

In a variant, it is curved, notably having one or more curves.

The core is preferably rectilinear. In a variant, the core is curved, notably having one or more curves. The curve(s) may have a radius of curvature of between 5 and 25°.

The core may comprise a plurality of curves, the curves all having the same radius of curvature or at least two of these curves having different radii of curvature.

In a further variant, the core has two rectilinear portions that form a bend with an angle of between 5° and 50°, better still between 10° and 30°, between one another. Preferably, the bend is closer to the distal end than the proximal end of the core; notably the distance of the bend from the proximal end is greater than or equal to 60% of the length of the core. The bend may have a radius of curvature of between 5 and 25°.

Such a bent shape of the core can allow the user to apply their makeup while keeping their elbow close to their body. Making up the eye is thus less difficult than with a brush with a rectilinear core. It also makes it easier to make up the eyelashes by holding the brush in a plane substantially perpendicular to the face, and easier to make up the eyelashes at the corner of the eye, notably the inner corner of the eye.

The length $L_1$ of the portion of the core carrying the bristles may be less than or equal to 50 mm, better still less than or equal to 40 mm, measured along the longitudinal axis of the brush. It is between 25 and 35 mm for example.

The brush may be chamfered at its ends.

A further subject of the invention is a packaging and application device comprising:

a container containing the product to be applied, a brush according to the invention.

The container may be provided with a wiping member for removing the excess product present on the stem and on the brush. This wiping member comprises for example a lip made of an elastomeric material, defining a wiping orifice of circular section, the diameter of which corresponds substantially to that of the stem.

A further subject of the invention is a method for manufacturing a brush according to the invention, comprising the steps of:

producing a brush blank having a rectilinear twisted core, cutting the bristles so as to form the cutout(s) so as to obtain a brush according to the invention, notably by moving a cutting tool both along an axis parallel to the longitudinal axis of the core and along an axis perpendicular to the longitudinal axis of the core, or by moving a cutting tool about an axis perpendicular to the longitudinal axis of the core, notably an axis parallel to the bottom of the cutout.

The manufacturing method may comprise the step of curving the core.

The cutting tool preferably has a longitudinal axis parallel or perpendicular to the bottom of the cutout, or perpendicular to the width of the cutout.

The cutting tool is preferably rotated about its longitudinal axis.

When the longitudinal axis of the cutting tool is perpendicular to the bottom of the cutout or to the width of the bottom of the cutout, the cutting surface may be formed by a base of the cylinder. In this case, the bottom of the cutout formed is preferably flat in cross section.

When the longitudinal axis of the cutting tool is parallel to the bottom of the cutout, the cutting surface is formed by the lateral surface of the cylinder. In this case, the cross-sectional profile of the bottom of the cutout depends on the profile of the generatrix of the cylinder.

The cutting tool may have a cylindrical shape with a generatrix oriented perpendicularly to the longitudinal axis of the core and perpendicularly to the bottom of the cutout.

The cutting tool preferably has a width substantially equal to the width w of the cutout.

The cutting tool may have a cutting surface with a planar shape or a shape that is concave towards the outside.

Figure 2:
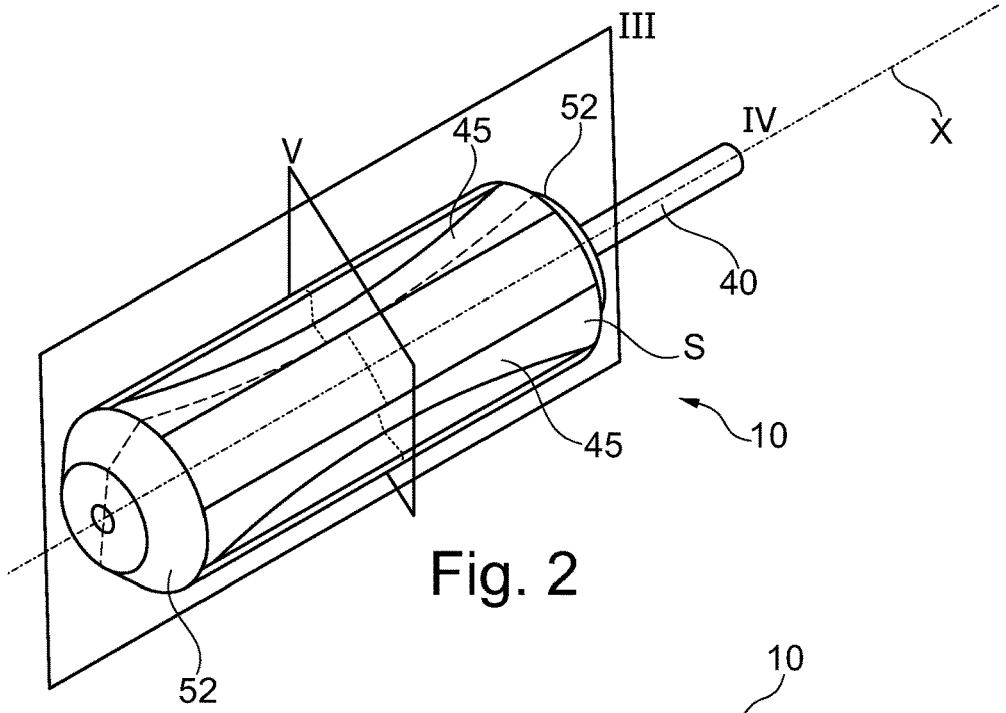
Figure 3:
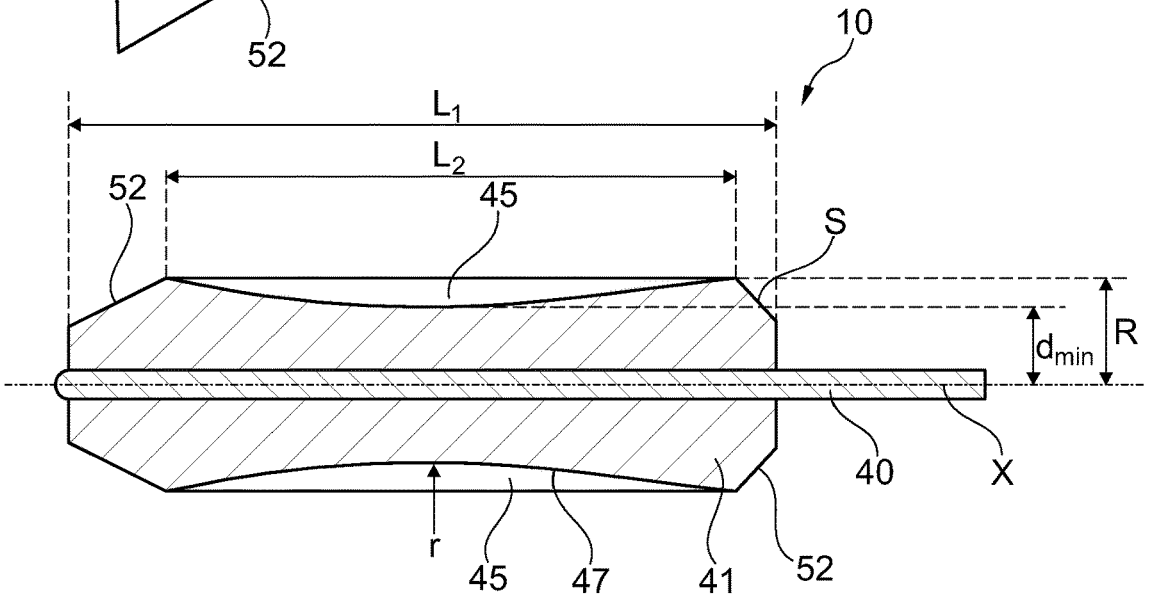
Figure 4:
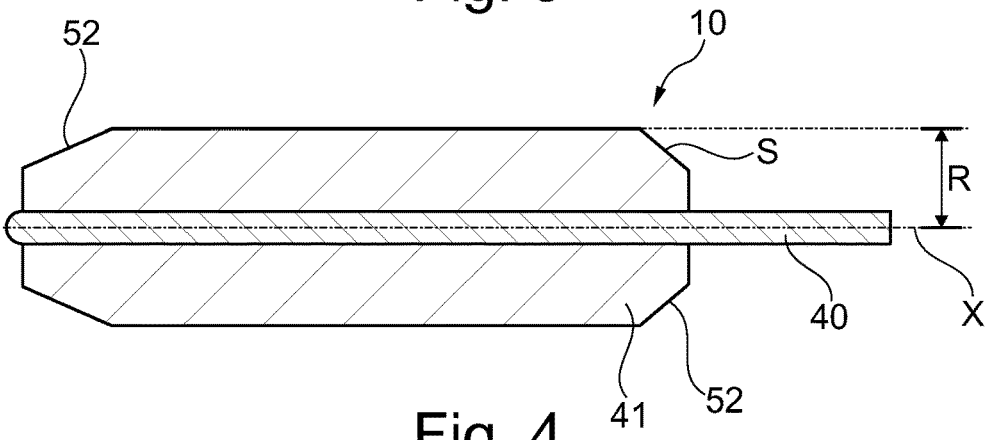
Figure 5:
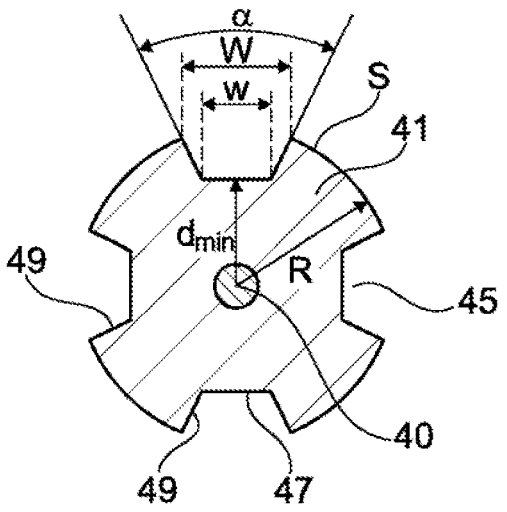
Figure 9:
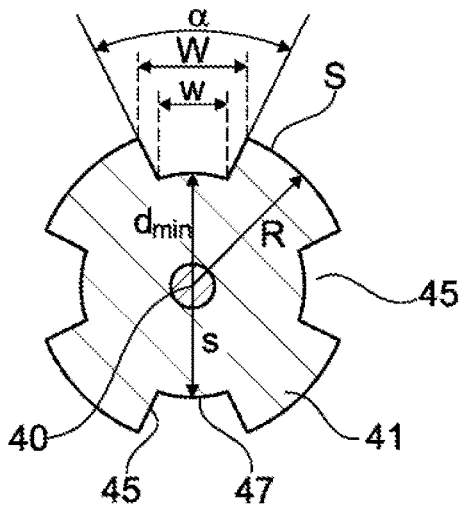
Figure 6:
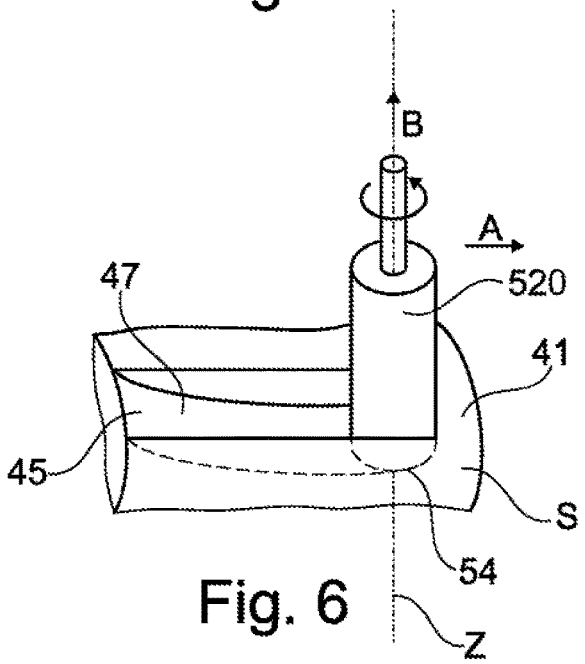
Figure 8:
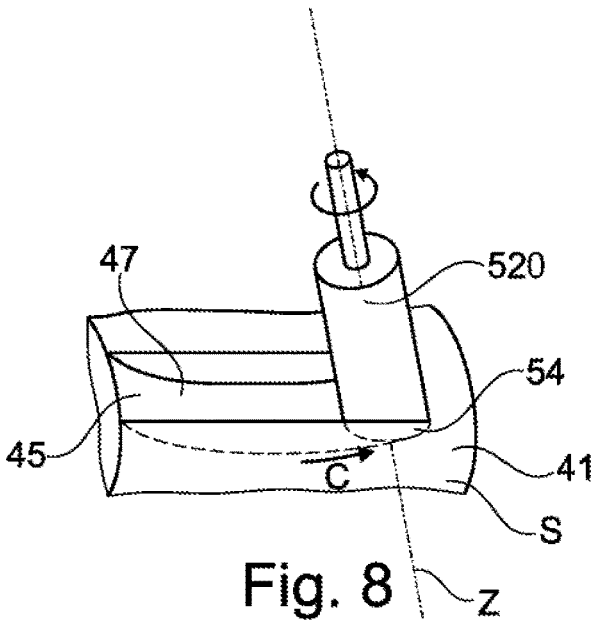
Figure 7:
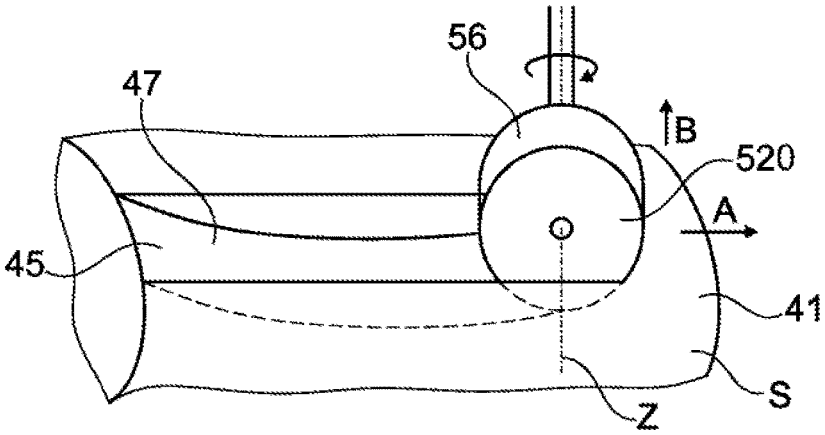
Figure 10A:
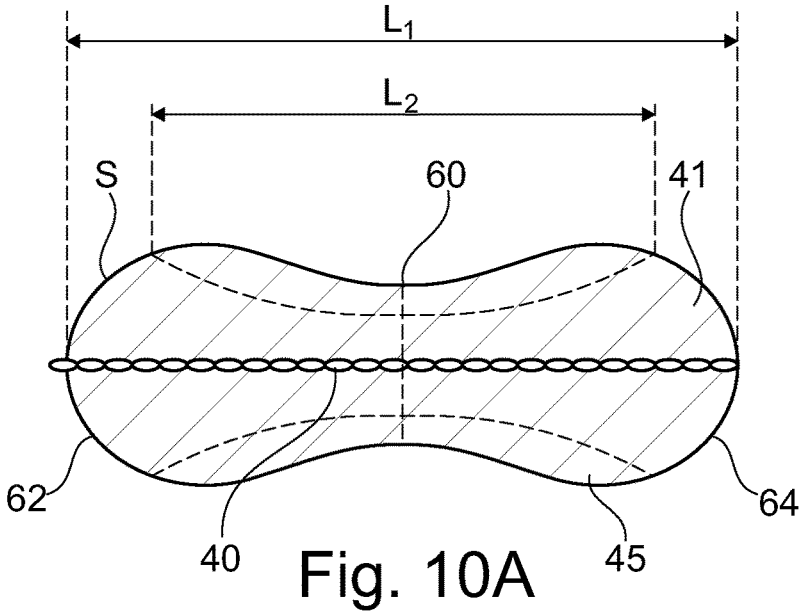
Figure 10B:
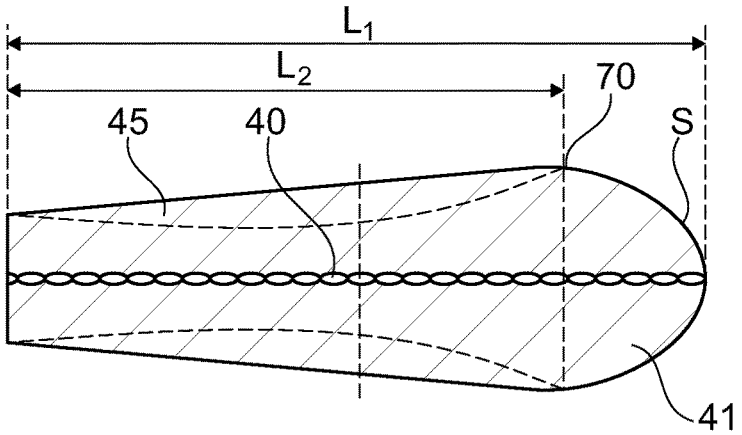
Figure 10C:
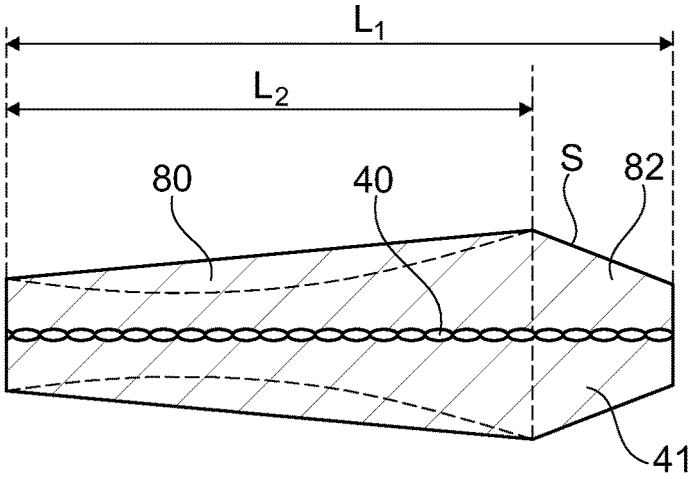
Figure 10D:
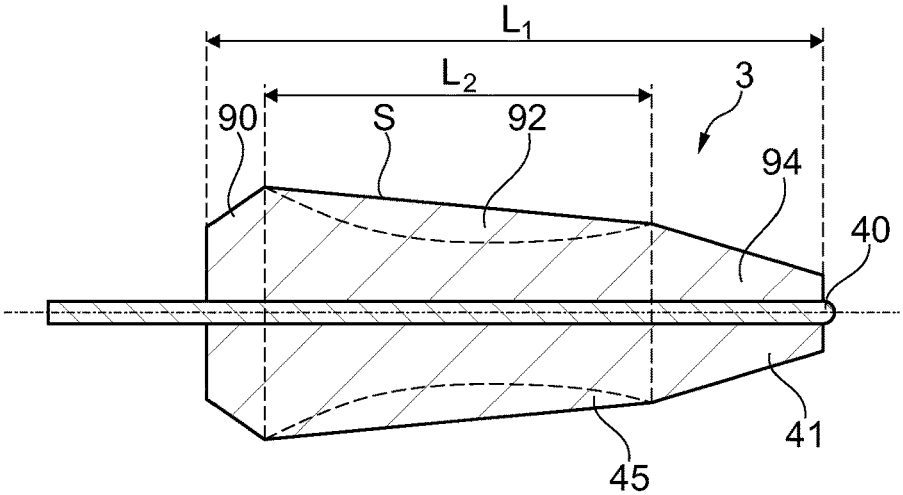
Figure 10E:
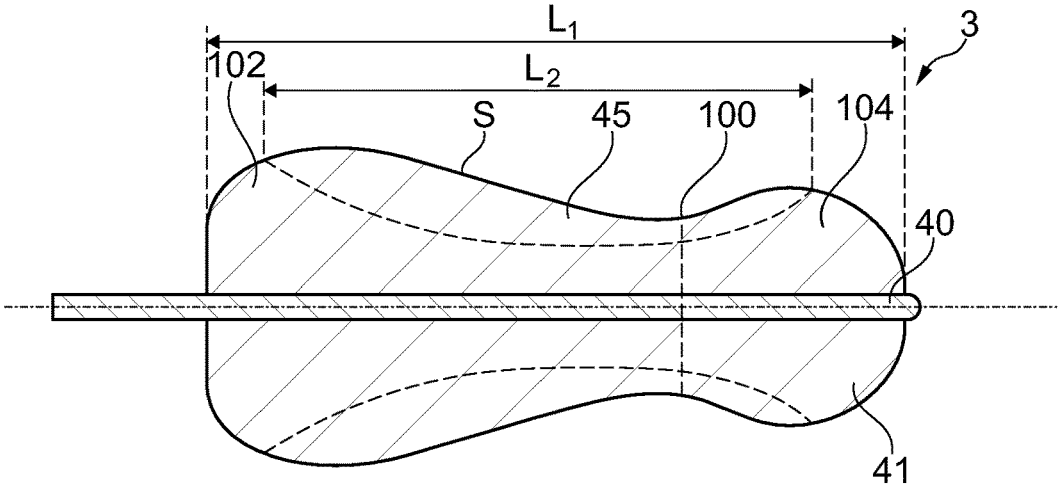
Figure 10F:
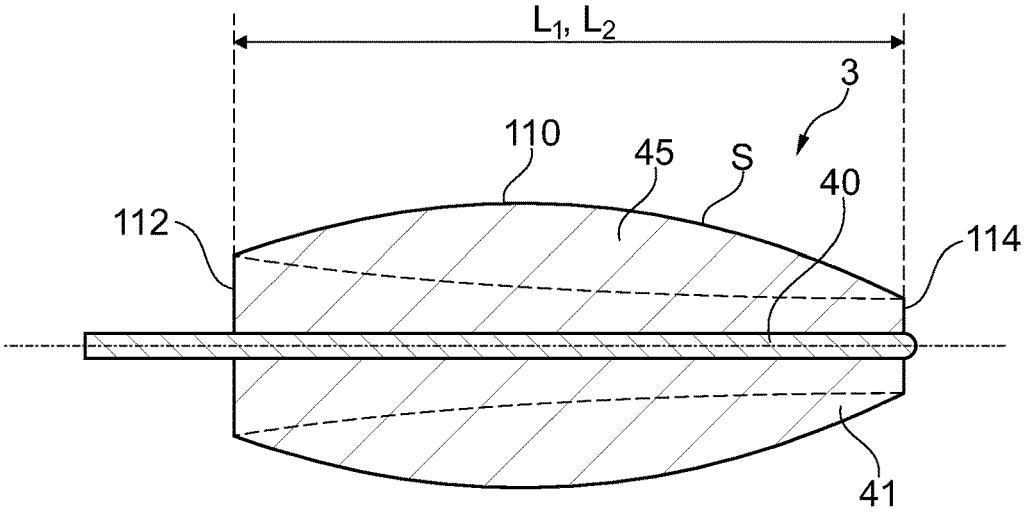
Figure 10G:
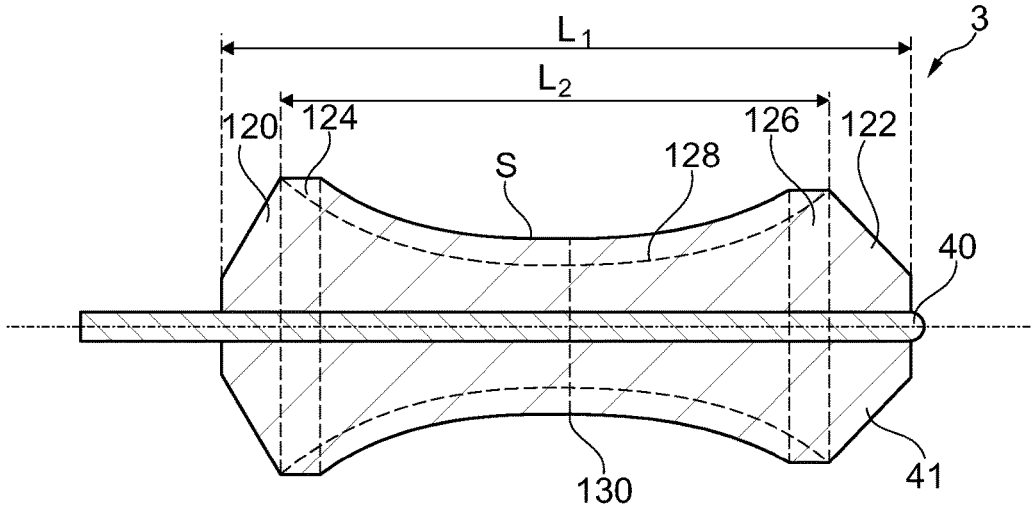
Figure 11:
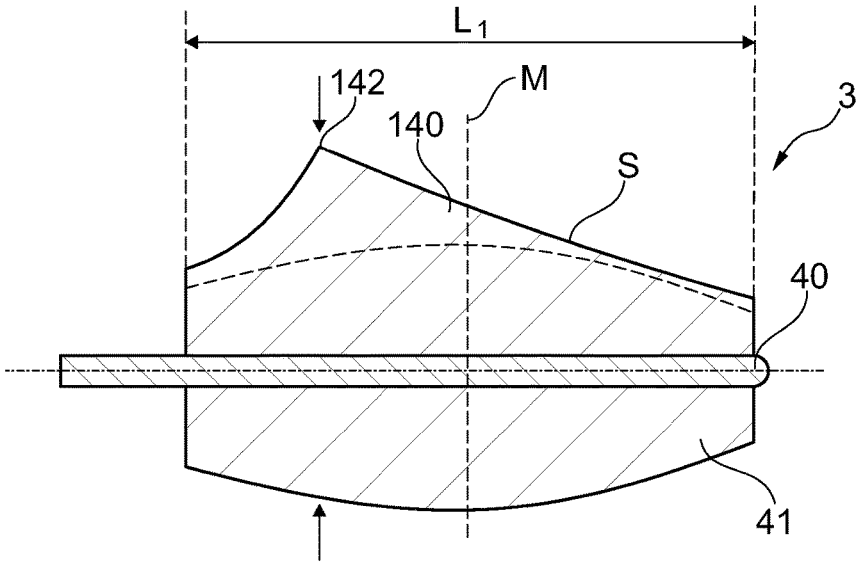
Figure 12:
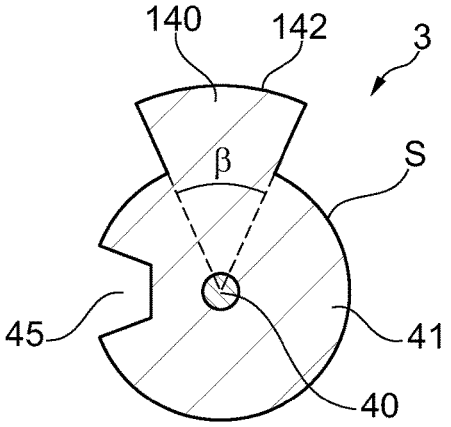
Figure 13:
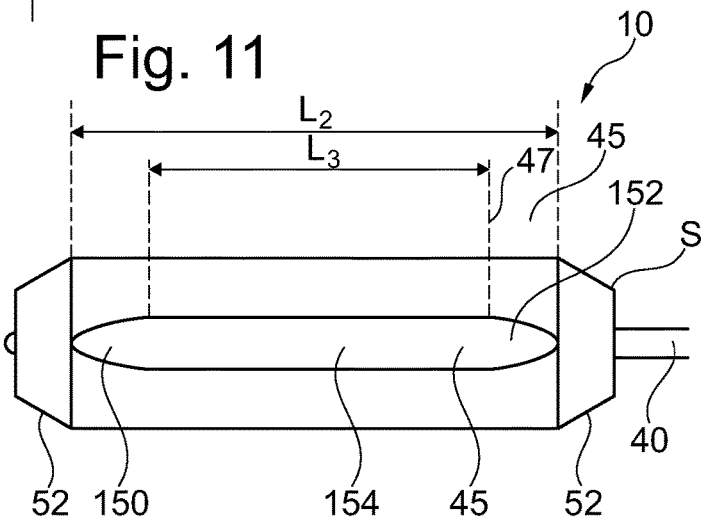

The invention may be better understood from reading the following detailed description of non-limiting illustrative embodiments thereof and from examining the appended drawing, in which:

FIG. 1 shows an example of a packaging and application device according to the invention, in schematic longitudinal section, FIG. 2 is a schematic perspective depiction of an example of a brush according to the invention, FIG. 3 is a cross-sectional view on III in FIG. 2, FIG. 4 is a cross-sectional view on IV in FIG. 2, FIG. 5 is a cross-sectional view on V in FIG. 2, FIG. 6 shows an example of a method for manufacturing a brush according to the invention, FIG. 7 shows a variant method for manufacturing a brush according to the invention, FIG. 8 shows a variant method for manufacturing a brush according to the invention, FIG. 9 is a view similar to FIG. 5 of a variant brush, FIGS. 10A to 10G are views similar to FIG. 4 of variant brushes, FIG. 11 is a longitudinal section through a variant brush according to the invention, FIG. 12 is a view on XII of the brush in FIG. 11, and FIG. 13 is a schematic top view of a variant brush according to the invention.

In the rest of the description, identical elements or elements having identical functions bear the same reference signs. Their description is not repeated for each of the figures, only the main differences between the embodiments being mentioned.

The packaging and application device 1 shown in FIG. 1 comprises a container 2 containing a product P to be applied to the eyelashes or eyebrows and an applicator 3 which may be fixed removably to the container 2 in the example in question. The product P comprises for example one or more pigments, in particular an iron oxide. It is for example a mascara.

The applicator 3 comprises a stem 5 of longitudinal axis Y, which is provided at a distal end 5*a* of the stem with a brush 10 according to the invention, and at the other end with a gripping member 11 that likewise forms a cap for closing the container 2 in a sealed manner. As can be seen notably in FIG. 1, the latter comprises a body 13 which is provided at the top with a threaded neck 14 onto which the gripping member 11 can be screwed in order to close the container 2 in a sealed manner. In a variant, the applicator can be fixed to the container in some other way.

The neck 14 may accommodate, as illustrated, a wiping member 20 which is for example inserted into the neck 14. This wiping member 20 comprises a lip 26 that defines a wiping orifice having a diameter adapted to that of the stem 5.

The brush 10 may be fixed, in a conventional manner, in a housing provided at the distal end 5*a* of the stem 5, which is advantageously made of a thermoplastic material. The brush 10 comprises a twisted metal core 40 which is fixed at one end in the corresponding housing of the stem 5 by a portion of the core that does not have bristles, it being possible for said portion to have a length of around 8 mm.

The core 40 carries bristles 41, the free ends of which define an envelope surface S of the brush 10, as illustrated in FIG. 2. As illustrated in FIG. 4, the bristles 41 extend along a length $L_1$ of the core of preferably between 25 mm and 35 mm, in this case substantially equal to 30 mm.

The core 40 is formed conventionally by two arms of a metal wire folded in a U-shape, the bristles 41 being held between the turns of the core 40. The diameter of the metal wire is for example between 0.1 and 1 mm. The diameter of the bristles is for example between 0.06 and 0.35 mm.

As illustrated in FIG. 2, the envelope surface S comprises cutouts 45 extending longitudinally along an axis substantially parallel to the longitudinal axis X of the core 40. As can be seen in FIG. 3, the cutouts 45 extend along a length $L_2$ greater than more than ⅔ of the length $L_1$ of the part of the core 40 carrying the bristles 41; in this case the length $L_2$ is greater than ¾ of the length $L_1$.

The envelope surface S, apart from the cutouts 45, has substantially the shape of a cylinder of revolution. The maximum radius R of the envelope surface S, corresponding to the radius of the smallest cylinder of revolution in which the brush is inscribed, is between 3 mm and 6 mm, in this case substantially equal to 4.2 mm.

The cutouts 45 are at a distance d from the longitudinal axis X, said distance being variable along their length $L_2$, notably a continuously variable distance d. In longitudinal section, as illustrated in FIG. 3, the cutouts 45 have a profile that is concave towards the outside, notably in a circular arc. The radius of curvature r of the profile of the cutouts 45 is preferably between 40 mm and 65 mm, for example around 50 mm.

The minimum distance $d_{min}$ from the longitudinal axis X is preferably between 2.5 and 3.5 mm, for example substantially equal to 3 mm. The ratio $d_{min}/R$ is preferably between 0.4 and 0.9, better still between 0.6 and 0.9, better still substantially equal to 0.7.

In the example illustrated in FIGS. 2 to 5, the envelope surface S comprises four identical cutouts 45 that are distributed evenly around the core 40. The cutouts 45 have a flat bottom 47. As can be seen in FIG. 2, the width w of the cutouts 45, measured at the bottom 47 of the cutouts 45, is constant along the entire length $L_2$ of the cutouts 45. The width w of the cutouts 45 is preferably between 1 mm and 4 mm, better still between 1.5 mm and 3.5 mm, in this case substantially equal to 2.3 mm.

The cutouts 45 have flanks 49 that diverge towards the outside and form an angle α of between 35° and 45°, in this case substantially equal to 40°, between one another. The width W of the cutouts 45, measured at the surface of the cutouts 45, is thus greater than the width w of the cutouts 45. The ratio of the widths w/W is preferably between 0.8 and 0.7, in this case substantially equal to 0.77.

As illustrated in FIGS. 2 and 3, the ends 52 of the envelope surface S are chamfered. This can make it easier for the brush 3 to pass through the wiper 20. The chamfer at the distal end and the chamfer at the proximal end are in this case different. The walls of the chamfer at the distal end are notably less inclined than that the walls of the chamfer at the proximal end.

The cutouts 45 can be produced using a cutting tool 520, illustrated in FIGS. 6 to 8. The cutting tool 520 is preferably in the form of a cylinder, notably a cylinder of revolution. The cutting tool 520 comprises a cutting surface that comes into contact with the bristles 41 and cuts the bristles 41 so as to form a cutout 45. The width of the cutting surface of the cutting tool 520 defines the width w of the cutout 45. The cutting tool 520 comprises a longitudinal axis Z and is rotated about said longitudinal axis Z. This makes it easier to cut the bristles.

In the example illustrated in FIG. 6, the bristles 41 are cut by moving the cutting tool 520 both in a direction A parallel to the longitudinal axis X and in a direction B perpendicular to the longitudinal axis X. The longitudinal axis Z is perpendicular to the width w of the bottom 47 of the cutout 45. The cutting surface is formed by the free base 54 of the cylinder forming the cutting tool 520. Such a cutting tool 520 makes it possible to obtain a cutout 45 having a flat bottom 47 in cross section.

In the example illustrated in FIG. 7, the bristles 41 are cut by moving the cutting tool 520 both in a direction A parallel to the longitudinal axis X and in a direction B perpendicular to the longitudinal axis X. The longitudinal axis Z is parallel to the bottom 47 of the cutout 45. The cutting surface is formed by the lateral surface 56 of the cylinder forming the cutting tool 520. The shape of the generatrix of the cylinder makes it possible, in this case, to define a particular shape for the bottom 47 of the cutout 45. For example, if the generatrix is a straight line, the bottom 47 will be flat in cross section, and if the generatrix is concave towards the outside, the bottom 47 will be convex towards the outside in cross section.

In the example illustrated in FIG. 8, the bristles 41 are cut by moving the cutting tool 520 about an axis perpendicular to the longitudinal axis X of the core and parallel to the bottom 47 of the cutout 45 in a direction C. The longitudinal axis Z is perpendicular to the bottom 47 of the cutout 45. The cutting surface is formed by the free base 54 of the cylinder forming the cutting tool 520. Such a cutting tool 520 makes it possible to obtain a cutout 45 having a flat bottom 47 in cross section.

The example illustrated in FIG. 9 differs from that illustrated in FIGS. 2 to 5 in that the shape of the bottom 47 of the cutouts 45 is convex towards the outside. In cross section, the bottom 47 of the cutouts 45 can form a circular arc with a radius substantially equal to d. As described above, in order to produce such a bottom 47, the cutting tool 520 can be as illustrated in FIG. 7.

The examples in FIGS. 10A to 10G differ from the one illustrated in FIGS. 2 to 5 by way of the shape of the envelope surface S.

FIGS. 10A to 10G have axisymmetric shapes.

In the example illustrated in FIG. 10A, the envelope surface S, apart from the cutouts, is peanut-shaped. It has a diameter that passes through a minimum 60 between two bulging portions 62 and 64, one 62 being proximal and the other 64 distal. The envelope surface S is symmetric with respect to the transverse plane of the minimum diameter. The cutouts 45 are made, for example, from one bulging portion 62 to the other 64, as illustrated.

In the example illustrated in FIG. 10B, the envelope surface S, apart from the cutouts, is bomb-shaped. It has a diameter that passes through a maximum 70 close to the distal end at a circle of greatest diameter. The body of the brush 3 is frustoconical, being connected at its base that is coincident with the circle of greatest diameter to the distal end part of the brush 3, of ogival shape. The cutouts 45 extend, for example, from the proximal end to the part of greatest diameter.

In the example illustrated in FIG. 10C, the envelope surface S, apart from the cutouts, is buoy-shaped. The envelope surface S is defined by two frustoconical portions 80 and 82 that are joined together by their base of greatest diameter. The cutouts 45 extend, for example, from the proximal end to the joint between the two frustoconical portions 80 and 82.

In the example illustrated in FIG. 10D, the envelope surface S, apart from the cutouts, is defined by 3 frustoconical portions 90, 92 and 94 that are joined together by their bases. The frustoconical portion 90 is situated at the proximal end and the portion 94 is situated at the distal end. The portion 92 extends between the two end portions 90 and 94 and is attached to the proximal portion 90 by its base of greatest diameter and to the distal portion 94 by its base of smallest diameter. The cutouts 45 extend, for example, only along the central portion 92.

In the example illustrated in FIG. 10E, the envelope surface S, apart from the cutouts, is in the form of an asymmetric peanut. It has a diameter that passes through a minimum 100 between two bulging portions 102 and 104, one 102 being proximal and the other 104 distal. The minimum 100 is closer to the distal end than to the proximal end. The bulging portions 102 and 104 have different greatest diameters, notably the greatest diameter of the portion 104 is smaller than the greatest diameter of the portion 102. The cutouts 45 are made, for example, from one bulging portion 102 to the other 104, as illustrated.

In the example illustrated in FIG. 10F, the envelope surface S, apart from the cutouts, also has a bulging shape. It has a diameter that passes through a maximum 110. This maximum 110 is situated substantially at the centre of the portion of the core carrying the bristles. The distal end 114 and the proximal end 112 have different diameters; notably the diameter of the distal end 114 is smaller than that of the proximal end 112. The cutouts 45 extend, for example, from the distal end 114 to the proximal end 112.

In the example illustrated in FIG. 10G, the envelope surface S, apart from the cutouts, has the overall shape of a diabolo with two frustoconical end portions 120 and 122 that are connected by their bases of greatest diameter to two cylindrical portions 124 and 126, respectively, which are themselves connected together by a portion 128 that narrows towards the centre. This portion 128 has a minimum diameter 130 substantially at the centre of the part of the core carrying the bristles. The cylindrical portions 124 and 126 have the same thickness and different diameters. The distal cylindrical portion 126 has a smaller diameter than the proximal cylindrical portion 124. The frustoconical portions 120 and 122 have the same thickness. The cutouts 45 are made, for example, from one cylindrical portion 124 to the other 126, as illustrated.

The example in FIGS. 11 and 12 differs from that in FIGS. 2 to 5 in that the envelope surface S is not axisymmetric and in that it has only one cutout 45.

The envelope surface S may have an angular sector 140 defined by bristles that are longer than the rest of the brush 3. The angular sector 140 extends along the entire length $L_1$ of the brush 3 and may have, in longitudinal section, a profile with a variable height with respect to the longitudinal axis X, notably a profile in the form of a dorsal fin. Within the angular sector 140, the height of the envelope surface S can pass through a maximum 142 close to the proximal end. The rest of the envelope surface S, apart from the cutout 45, can have a symmetrical bulging shape with respect to a mid-plane M. The cutout 45 can extend along the envelope surface S from the proximal end to the distal end, somewhere other than the angular sector.

In a variant, the cutout 45 can extend along the angular sector 140 from the proximal end to the distal end.

The example in FIG. 13 differs from that in FIGS. 2 to 5 in that the cutouts 45 have a width w that is variable in two portions 150 and 152 and constant in a portion 154 extending between the portions 150 and 152. The portion 154 has a length $L_3$ that makes up more than 50% of the length $L_2$ of the cutout 45.

Generally, the envelope surface can comprise a different number of cutouts and it is possible for the latter not to be identical to one another and/or distributed evenly around the core 40.

In a variant, the envelope surface may have any other shape, which is or is not axisymmetric.

The profile of the cutouts in longitudinal section may have angular points, and notably be formed by joined-together segments.

The invention is not limited to the exemplary embodiments which have just been described, the characteristics of which may be combined with one another as parts of variants which are not illustrated.

For example, the cutouts of the examples in FIGS. 10A to 12 can have a concave bottom as illustrated in FIG. 9.

The expression "comprising a" should be understood as being synonymous with "comprising at least".

The invention claimed is:

1. A brush for applying a product to the eyelashes and/or eyebrows, comprising:

a twisted core having a longitudinal axis, the twisted core extends along a longitudinal axis of the brush, and bristles that extend from the core along a portion of length $L_1$, the ends of the bristles defining an envelope surface S, the envelope surface S having at least one longitudinally extending cutout, the cutout being bordered and defined by flanks and having:

a length $L_2$ where $L_2 \geq L_1/2$, a width w, measured at a bottom of the cutout, that is constant along at least a portion with a length $L_3$ along the longitudinal axis greater than or equal to 50% of its length $L_2$, and a distance d from the longitudinal axis that varies along its length $L_2$, the bottom of the cutout of the envelope surface having, in a longitudinal section comprising the longitudinal axis of the core, a profile that is concave towards an outside of the brush.

2. The brush according to claim 1, wherein the bottom of the cutout is, in a section perpendicular to the longitudinal axis of the core, flat or convex towards the outside of the brush.

3. The brush according to claim 1, wherein the flanks that define the cutout diverge relative to one another in a direction extending towards the outside of the brush.

4. The brush according to claim 1, wherein the distance d from the longitudinal axis varies continuously along its length $L_2$.

5. The brush according to claim 1, wherein the distance d of the cutout from the longitudinal axis forms a curve that does not have any angular points.

6. The brush according to claim 1, wherein the length $L_2$ of the cutout is such that $L_2 \geq 2/3L_1$.

7. The brush according to claim 1, wherein the ratio w/W is between 0.9 and 0.4, W being the width of the cutout measured at a top surface of the cutout immediately adjacent to a top surface of the flanks.

8. The brush according to claim 1, wherein the envelope surface S has a plurality of cutouts.

9. The brush according to claim 8, wherein the cutouts are distributed evenly around the core.

10. The brush according to claim 9, wherein the ratio w/D is between 0.4 and 0.1, D being the diameter of the cross section of the envelope surface S, apart from the cutouts.

11. The brush according to claim 1, wherein the brush is chamfered at its ends.

12. A packaging and application device comprising:

a container containing the product to be applied, a brush according to claim 1.

13. A method for manufacturing a brush according to the invention, comprising the steps of:

producing a brush blank having a rectilinear twisted core, cutting the bristles so as to form the cutout(s) so as to obtain a brush according to claim 1, optionally curving the core.

14. The brush according to claim 1, wherein depth of the cutout varies relative to the twisted core along the longitudinal axes of the cutout and brush.

* * * * *